US010926321B2

(12) United States Patent
Mulcahy et al.

(10) Patent No.: US 10,926,321 B2
(45) Date of Patent: Feb. 23, 2021

(54) SYSTEM AND METHOD FOR CONTINUOUS CASTING OF MOLTEN MATERIAL

(71) Applicant: 2700585 Ontario Inc., Whitby (CA)

(72) Inventors: Joseph Mulcahy, Whitby (CA); Navtej Saluja, Richmond Hill (CA)

(73) Assignee: 2700585 Ontario Inc., Whitby (CA)

( * ) Notice: Subject to any disclaimer, the term of this patent is extended or adjusted under 35 U.S.C. 154(b) by 0 days.

(21) Appl. No.: 15/801,888

(22) Filed: Nov. 2, 2017

(65) Prior Publication Data

US 2018/0185908 A1 Jul. 5, 2018

Related U.S. Application Data

(60) Provisional application No. 62/418,857, filed on Nov. 8, 2016.

(51) Int. Cl.

| | |
|---|---|
| ***B22D 11/115*** | (2006.01) |
| ***B22D 11/12*** | (2006.01) |
| ***B22D 11/055*** | (2006.01) |
| *B22D 27/02* | (2006.01) |
| *B22D 11/045* | (2006.01) |

(52) U.S. Cl.

CPC ..... *B22D 11/115* (2013.01); *B22D 11/055* (2013.01); *B22D 11/122* (2013.01); *B22D 11/045* (2013.01); *B22D 27/02* (2013.01)

(58) Field of Classification Search

CPC ... B22D 11/115; B22D 11/051; B22D 11/053; B22D 11/0535; B22D 11/055; B22D 11/122; B22D 11/045; B22D 11/124; B22D 11/1246; B22D 11/205; B22D 11/22; B22D 11/225

See application file for complete search history.

(56) References Cited

U.S. PATENT DOCUMENTS

| | | | | |
|---|---|---|---|---|
| 4,522,249 | A | 6/1985 | Mulcah | |
| 4,582,110 | A | 4/1986 | Mizota | |
| 4,732,208 | A * | 3/1988 | Larsson | B22D 11/115 164/468 |
| 5,279,351 | A * | 1/1994 | Metz | B22D 11/122 164/468 |
| 5,988,261 | A | 11/1999 | Milorad et al. | |

(Continued)

FOREIGN PATENT DOCUMENTS

EP 1001862 B1 2/2002

*Primary Examiner* — Kevin P Kerns

*Assistant Examiner* — Steven S Ha

(74) *Attorney, Agent, or Firm* — Tucker Ellis LLP

(57) ABSTRACT

An apparatus for continuous casting of molten material includes an elongate tube of electrically conductive material having an inner and an outer wall defining a molding cavity therein, the inner and outer walls having a first end having an inlet for receiving the molten material and a second end having an outlet for removing a solidifying billet formed from the molten material; an electrical coil with inner and outer surfaces, the electrical coil arranged to surround the outer wall of the elongate tube; and an annular channel defined by the outer wall of the elongate tube and the inner surface of the electrical coil. When pulsating current passes through the electrical coil, a counter current is induced in the elongate mold causing a repelling force between the electrical coil and the elongate mold, thereby causing inward radial flexure of the elongate mold.

16 Claims, 10 Drawing Sheets

(56) References Cited

U.S. PATENT DOCUMENTS

| | | | | |
|---|---|---|---|---|
| 6,003,590 | A | 12/1999 | Pavlicevic et al. | |
| 6,386,271 | B1 | 5/2002 | Kawamoto et al. | |
| 2015/0151355 | A1* | 6/2015 | De Monte ..... | B22D 11/115 164/451 |

* cited by examiner

SYSTEM AND METHOD FOR CONTINUOUS CASTING OF MOLTEN MATERIAL

RELATED APPLICATIONS

This application claims the benefit of U.S. Provisional Application No. 62/418,857 filed Nov. 8, 2016, which is hereby incorporated herein by reference.

FIELD OF THE INVENTION

The present invention relates to the continuous casting of molten materials and in particular, a system and method for the continuous casting of molten materials.

BACKGROUND OF THE INVENTION

In conventional casting of steel, mold oscillations are used to minimize friction and sticking of the solidifying shell, and to avoid shell tearing and liquid steel breakouts. Oscillation is usually achieved either hydraulically or via motor driven cams or levers which support and reciprocate the mold.

Conventional mold oscillation has many disadvantages, including the requirement for mechanical and hydraulic gear to oscillate the mold; a fixed refractory connection with the tundish is not possible if the mold is mechanically oscillated; partial oxidation of the metal due to surface perturbations; the requirement for loop control to maintain constant melt flow when mechanical oscillations are used; and the formation of oscillational marks on the surface of the cast product.

One solution to this problem is illustrated in U.S. Pat. No. 4,522,249, where a magnetic pulse is applied to a coil held in a mandrel, which, in turn, applies pressure to the mold and contracts the cross-sectional dimension of the molten metal. In this arrangement, it was found that the coil underwent physical deformation from the mandrel. While the coil is reparable or replaceable, repairs and/or replacement result in downtime of the system, leading to loss of production and replacement of the coil is costly. This mandrel arrangement has limited current carrying capacity; much lower than the current carrying capacity of the coil itself. Thus, induced counter currents in the mandrel resulted in reduced repelling forces. Additionally, internal cooling of the coil leads to several difficulties. For example, high flow rates are required to keep the coil cool, however, because of the coil enclosure, flow rate is limited.

There is a need to provide an improved apparatus and method for the continuous casting of molten material.

SUMMARY OF THE INVENTION

It is an object of the present invention to provide an improved apparatus and method for the continuous casting of molten material that overcome disadvantages of the prior art apparatuses and methods.

In accordance with an aspect of the invention, there is provided a method of continuous casting of a molten material, the method comprising the steps of: continuously feeding the molten material into an elongate molding cavity of an elongate mold, the elongate mold having an inner wall and an outer wall defining the cavity therein, an inlet at a first end of the elongate mold for receiving the molten material, an outlet at a second end of the elongate mold for outputting a solidifying billet of the molten material, the mold being constructed of an electromagnetic material; continuously flowing cooling water into an annular channel formed between the outer wall of the elongate mold and an inner surface of an electrical coil arranged in a helical direction around the outer wall of the elongate mold, the annular channel for receiving the continuously flowing cooling water from a water inlet and passing the continuously flowing cooling water therethrough to a water outlet to cool the coil, the elongate mold, and the molten material contacting the inner wall; continuously applying a pulsating current to the electrical coil, the pulsating current inducing a counter current in the elongate mold, the counter current causing a repelling force between the coil and the elongate mold thereby causing a flexure of the elongate mold; and removing the solidifying billet from the outlet of said elongate mold.

In an embodiment of the present invention, at the step of applying a pulsating current, the method further comprising simultaneously inducing electromagnetic forces via electromagnetic stirrers arranged substantially circumferentially around the elongate mold such that the electromagnetic forces cause the molten material to be stirred within the molding cavity.

In an embodiment of the present invention, at the step of applying a pulsating current, the method further comprising simultaneously inducing electromagnetic forces via electromagnetic stirrers arranged substantially circumferentially around the cast product beyond the exit end of the elongate mold.

In an embodiment of the present invention, at the step of applying a pulsating current, the method further comprising simultaneously inducing electromagnetic forces via electromagnetic stirrers arranged around the elongate mold such that the electromagnetic forces cause the molten material to be stirred within the molding cavity and arranged substantially circumferentially around the cast product beyond the exit end of the elongate mold.

In an embodiment of the present invention, the electromagnetic stirrers are placed around the mold in areas where the molten material is substantially still liquid, areas in which the mold is being pulsated where the molten material is solidifying and substantially mushy, and areas in which the mold is outside the pulsating magnetic field where the molten material is solidifying and substantially mushy.

In an embodiment of the present invention, the electromagnetic stirrers stir in a substantially longitudinal direction corresponding to a direction substantially parallel to the feeding of the molten material.

In an embodiment of the present invention, the electromagnetic stirrers stir in a substantially lateral direction corresponding to a direction substantially perpendicular to the feeding of the molten material.

In an embodiment of the present invention, the electromagnetic stirrers stir in a substantially helical direction.

In an embodiment of the present invention, the rapidly pulsating magnetic field has a pulse duration of about 1 millisecond to about 2 milliseconds and an intensity of about 1000 to about 5000 amperes peak.

In an embodiment of the present invention, the magnetic field has a pulse interval of about 10 to about 100 times per second.

In an embodiment of the present invention, the elongate molding cavity has a substantially circular cross-section.

In an embodiment of the present invention, the elongate molding cavity has a substantially rectangular cross-section.

In an embodiment of the present invention, the elongate molding cavity has a substantially dog-bone cross-section.

In an embodiment of the present invention, the molten material is selected from the group consisting of steel, aluminum, aluminum alloy, and aluminum based metal-matrix composite.

In an embodiment of the present invention, the electro-conductive material is copper.

In accordance with an aspect of the present invention, there is provided an apparatus for continuous casting of molten material, said apparatus comprising: an elongate tube of electrically conductive material having an inner and an outer wall defining a molding cavity therein, the inner and outer walls having a first end having an inlet for receiving the molten material and a second end having an outlet for removing a solidifying billet formed from the molten material; an electrical coil with an inner surface and an outer surface, the electrical coil arranged to surround the outer wall of the elongate tube; an annular channel defined by the outer wall of the elongate tube and the inner surface of the electrical coil, the annular channel for receiving a flow of cooling water from a water inlet and passing the cooling water therethrough to a water outlet; and wherein when pulsating current passes through the electrical coil, a counter current is induced in the elongate mold causing a repelling force between the electrical coil and the elongate mold, thereby causing inward radial flexure of the elongate mold.

In an embodiment of the present invention, the apparatus further comprises electromagnetic stirrers arranged substantially circumferentially around the mold to induce electromagnetic forces to cause the molten material to be stirred within the molding cavity.

In an embodiment of the present invention, the apparatus further comprises electromagnetic stirrers arranged substantially circumferentially around the cast product beyond the exit end of the elongate mold.

In an embodiment of the present invention, the apparatus further comprises electromagnetic stirrers arranged around the elongate mold to induce electromagnetic forces to cause the molten material to be stirred within the molding cavity and arranged substantially circumferentially around the cast product beyond the exit end of the elongate mold.

In an embodiment of the present invention, the electromagnetic stirrers are placed around the mold in areas where the molten material is still substantially liquid, and areas in which the mold is being pulsated where the molten material is solidifying and substantially mushy, areas in which the mold is outside the pulsating magnetic field where the molten material is solidifying and substantially mushy.

In an embodiment of the present invention, the electromagnetic stirrers stir in a substantially longitudinal direction corresponding to a direction substantially parallel to the feeding of the molten material.

In an embodiment of the present invention, the electromagnetic stirrers stir in a substantially lateral direction corresponding to a direction substantially perpendicular to the feeding of the molten material.

In an embodiment of the present invention, the electromagnetic stirrers stir in a substantially helical direction.

In an embodiment of the present invention, rapidly pulsating magnetic field has a pulse duration of about 1 millisecond to about 2 milliseconds and an intensity of about 1000 to about 5000 amperes peak.

In an embodiment of the present invention, the magnetic field has a pulse interval of about 10 to about 100 times per second.

In an embodiment of the present invention, the apparatus further comprises compression rods to restrain the coil.

In an embodiment of the present invention, the elongate tube is arranged substantially horizontal.

In an embodiment of the present invention, the elongate molding cavity has a substantially circular cross-section.

In an embodiment of the present invention, the elongate molding cavity has a substantially rectangular cross-section.

In an embodiment of the present invention, the elongate molding cavity has a substantially dog-bone cross-section.

In an embodiment of the present invention, the molten material is selected from the group consisting of steel, aluminum, aluminum alloy, and aluminum based metal-matrix composite.

In an embodiment of the present invention, the electro-conductive material is copper.

BRIEF DESCRIPTION OF THE DRAWINGS

Embodiments of the present invention will now be described, by way of example only, with reference to the attached Figures, wherein.

DETAILED DESCRIPTION OF THE EMBODIMENTS

In pulse mold casting in accordance with the present invention, the need for mechanical oscillations is eliminated, by creating a near frictionless movement in the direction of casting by electromagnetically oscillating the mold perpendicular to the direction of casting. When oscillating the mold in this manner, the mold wall detaches itself from the solidifying shell of molten material, allowing the cast product to be withdrawn from the mold efficiently and easily, resulting in a uniform surface finish of the product.

Figure 1:
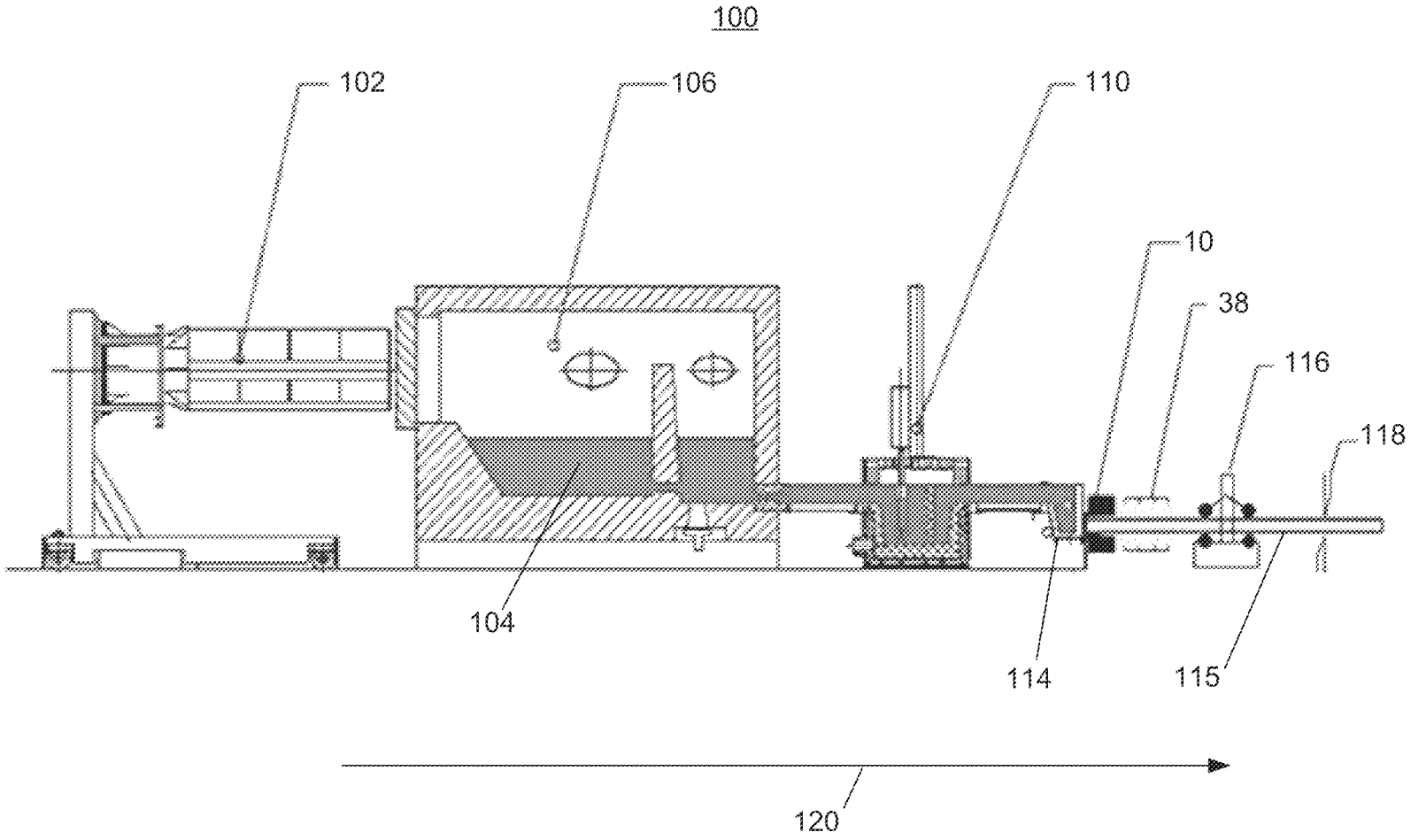
FIG. 1 illustrates a vertical cross-sectional side view of an exemplary system for continuous casting incorporating an exemplary continuous casting mold in accordance with an embodiment of the present invention.

Referring to the drawings, FIG. 1 shows an exemplary continuous casting system incorporating a mold in accordance with an embodiment of the present invention, for the casting of molten materials such as metals or metal alloys, which is generally referenced by the number 100.

Charge handling unit 102 feeds the solid or liquid material (not shown) into a melting furnace 106. FIG. 1 shows a dual chamber melting furnace 106, however, this may be implemented as two distinct furnaces: one for melting, and one for alloying and holding the material in its proper alloyed state. The furnace 106 may be 'tapped', where molten material 104 is poured from the furnace 106, in different ways, and in one version the furnace 106 can be tilted to pour the material out.

Induction coils (not shown) are placed around or inside the crucible of the furnace 106. The induction coils are used to stir the molten material 104 in the furnace 106. Induction induces flow streamlines in the molten material 104 which is electrically conducting, thereby mixing the alloying elements and promoting homogeneity in the molten material 104.

The melt is further purified through a process of degassing in the degassing unit 110. In one example, for aluminum alloys, the dissolved hydrogen is removed. In this case, a rotary impeller degasser (RIM) may be used. Because aluminum is extremely reactive when it comes in contact with moist air or wet tools, the water decomposes to release hydrogen in the melt. This dissolved hydrogen then causes casting defects like porosity. The chemical reaction is represented by the following equation: $2Al+3H_2O=Al_2O_3+6H$. Solubility of gaseous hydrogen falls sharply when aluminum solidifies, releasing excess hydrogen upon solidification which causes porosity.

In the example where the degassing unit 110 is a RIM, an inert or chemically inactive gas (argon, nitrogen etc.) is purged through a rotating shaft and rotor (not shown). The energy of the rotating shaft causes formation of a large number of fine bubbles providing very high surface area-to volume ratio. The large surface area promotes fast and effective diffusion of hydrogen into the gas bubbles resulting in equalizing activity of hydrogen in liquid and gaseous phases.

Turning back to FIG. 1, a tundish 114 is located above or before the continuous casting mold 10 in accordance with an embodiment of the present invention to feed the molten material 104 to the mold 10 at a regulated rate. Tundish-to-mold melt flow regulation occurs through orifice devices of various designs: slide gates, stopper rods, or metering nozzles (not shown).

Figure 2:
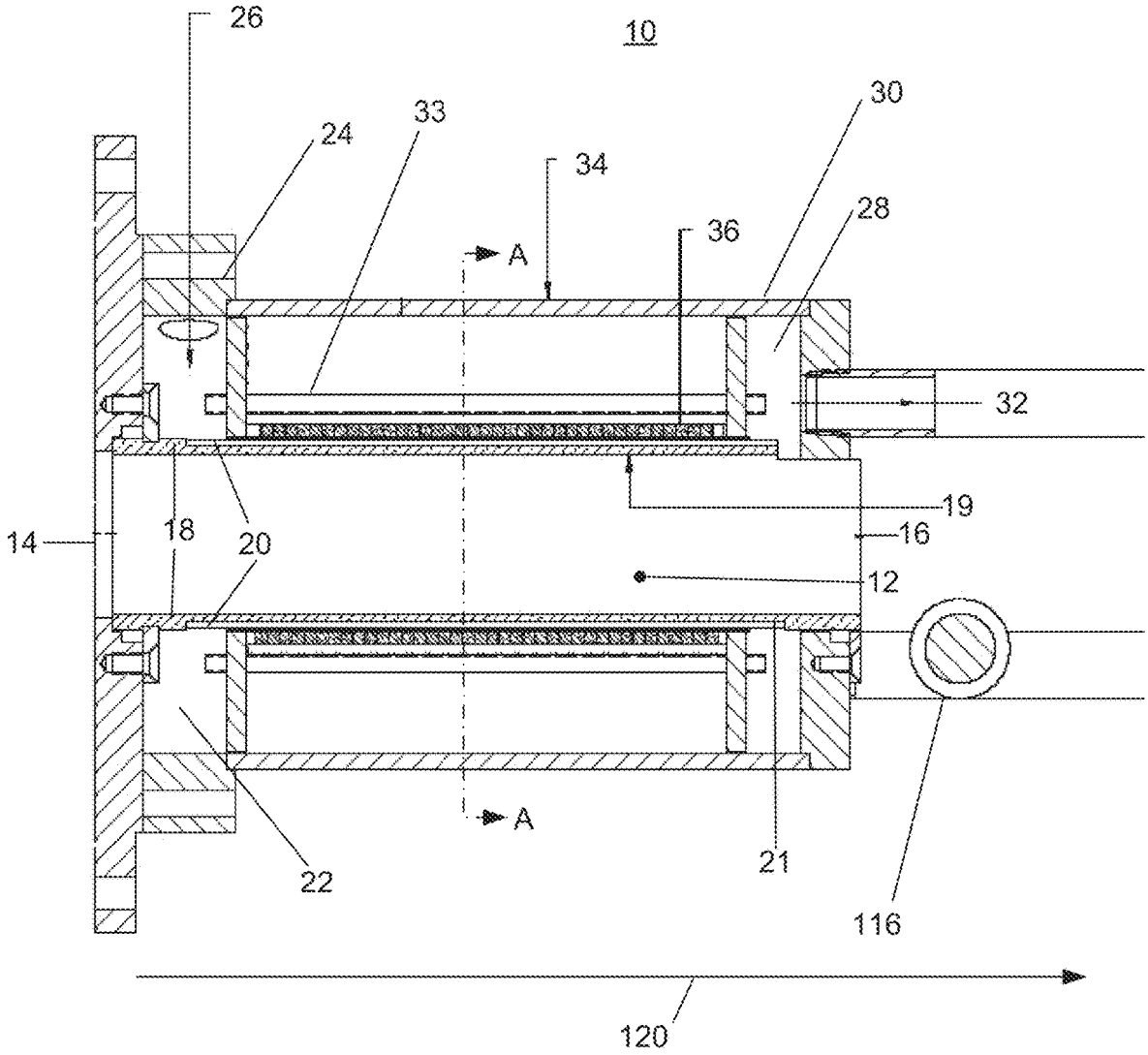
FIG. 2 illustrates a vertical cross-sectional side view of an exemplary continuous casting mold in accordance with an embodiment of the present invention.

The continuous casting mold 10 in accordance with an embodiment of the present invention is shown in greater detail in FIG. 2. The mold 10 comprises tubular mold member 18 forming an elongate cavity 12, having an inlet 14 at one end for receiving molten material to be cast from a tundish 114 and an outlet 16 for cooled solidifying material at the other end.

The elongate cavity 12 in the illustrated embodiment in FIG. 2 is of circular cross section. Other cross-sectional shapes may be used to form metal rods of corresponding shape, such as, a rectangular cross section, a dog-bone cross section or the like. The elongate cavity 12 is provided within a tubular mold member 18 having an inner cylindrical wall 19 and an outer surface 21.

The tubular mold member 18 is constructed of any convenient electroconductive material in which a magnetic field may be induced and which maintains the solid state upon passage of the molten material therethrough. One suitable material of construction is copper, which may be alloyed with other metals to increase its toughness.

Figure 3A:
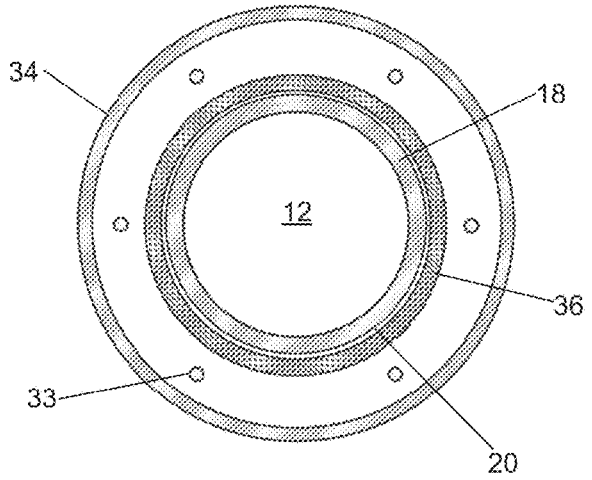
FIG. 3A illustrates the cross-sectional view A-A through the mold of FIG. 2.

In the illustrated embodiments of FIGS. 1, 2, and 3A, the mold 10 is arranged horizontally, so that the molten material flows through the mold cavity 12 in a horizontal direction. The characteristics of the mold 10, as discussed in more detail below, are applicable to any orientation of the mold and direction of molten material flow, including vertical orientation with upward or downward material flow and angular orientation with uphill or downhill material flow.

The outer surface 21 is wrapped with a current-carrying coil 36. The length of the coil 36 is determined by the solidification characteristics of the material, such as the metal or alloy being cast. The coil 36 is pulsed with a coil current in 'pulsed form', i.e., it is a sinusoidal form that is switched on and off. A typical pulsing frequency could be 10 pulses per second.

Between the coil 36 and the outer surface 21 of the mold member 18, is a narrow gap of from about 5 to about 6 mm. This gap acts as a cooling passage 20 which allows cooling liquid to be pumped therethrough at a high flow rate. The most common coolant is water. Water's high heat capacity and low cost makes it a suitable heat-transfer medium. This cooling water cools the outer surface 21 of the mold member 18 as well as the surface of the coil 36 that is facing the cooling passage 20. The water flow rate in the cooling passage is high enough so that it does not vaporize from the heat and cause any cavitation. Adjacent the inlet end 14 of the mold cavity 12, the upstream end of the cooling passage 20 communicates with a first annular cavity 22 defined by a water inlet housing 24 having an inlet passage 26 for the flow of fresh cooling water to the cavity 22 and thence to the cooling passage 20. Adjacent the outlet end 16 of the mold cavity 12, the downstream end of the cooling passage 20 communicates with a second annular cavity 28 defined by a water outlet housing 30 having an outlet passage 32 for the flow of used cooling water from the cavity 28. If desired, the cooling water may be caused to flow in the opposite direction through the cooling passage 20 by reversing the flow of water through the passages 26 and 32.

Figure 3B:
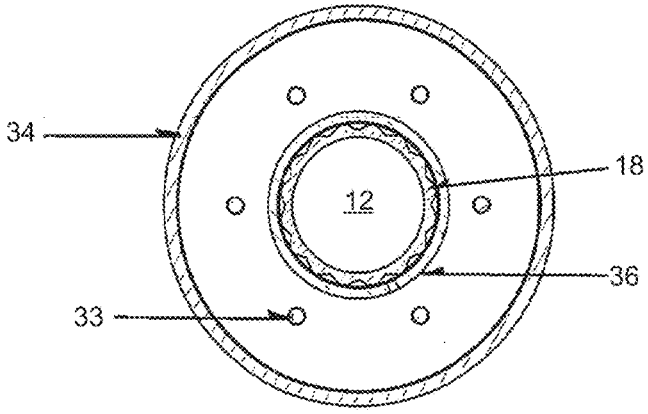
FIG. 3B illustrates a vertical cross-sectional end view through an exemplary continuous casting mold in accordance with another embodiment of the present invention.

FIG. 3B shows an alternate embodiment of the cross-sectional view to FIG. 3A. In FIG. 3B, the outer wall 21 of the mold member 18 is grooved. The coil 36 is wrapped around the outer wall 21 and abuts the outer wall 21 at the peaks of the grooves, thus forming a plurality of channels in the valleys of grooves of the outer wall 21. Cooling water may be continuously flowed through the plurality of channels.

Because the coil 36 becomes heated due to the passage of the current, through resistive heat (also called 'Joule heating' or I2R type of heating), cooling of the coil is advantageous since this heat will continually build up with time as energy=power×time.

The mold member 18, in turn, is made of electroconductive material which also needs to be cooled so that in the casting direction, the material can progressively solidify since the solidification front moves from the inner mold wall 19 to the center of the mold cavity 12.

Turning back to FIG. 1, after the molten material 104 solidifies in the mold 10, a solidifying bar 115, wire, or billet exits the pulse casting machine. The bar 115 is kept straight using guiding and straightening rolls 116. Then the bar 115 is either cut into pre-determined pieces by a shearing machine 118 or fed into another machine like a rolling mill (not shown). In some cases, before the bar 115 is introduced for further processing (e.g. rolling), it may be heated again for further temperature regulation.

Returning to FIG. 2, surrounding and defining the outer wall of the cooling passage 20 is an elongate coil housing 34 having wire coil 36 therein adjacent the radially inner wall of the coil housing 34. The coil housing 34 may be constructed of materials like stainless steel which allow electromagnetic stirrers to be placed around the coil housing 34.

The coil 36 may be a solid copper conductor that communicates with electrical power inlet and outlet wires (not shown), which, in turn, are connected to a source of pulsating current (not shown), to provide in cyclic manner, short bursts of current through the coil windings, thereby producing a short duration intense magnetic field. Each pulse through the coil 36 produces a force causing the coil 36 to deform in a longitudinal and lateral direction to the coil 36. Steel compression rods 33 in the coil housing 34 restrain the coil 36 in a longitudinal direction to prevent this deformation of the coil 36. In another embodiment, the coil 36 may be encased in a high strength material to withstand deformation and vibrations.

The pulses are generated by electromagnetic interactions. Electromagnetic fields are created by the passage of pulsed current in the coil 36 which encircles the mold member 18. This field causes an opposite and almost equal current to be induced in the mold member 18 (minus some electromagnetic decay and losses).

The interaction of these two currents (coil current and induced current) creates a repelling force between the coil 36 and the mold member 18. This force tends to displace the mold member 18 in a direction perpendicular to casting (that is, the direction of primary molten material flow and product withdrawal).

The force of repulsion is proportional to the product of the magnitudes of the coil current and the induced current in the copper mold:

$$F_{repulsion} \propto i_1 \times i_2$$

where $F_{repulsion}$ is the force of repulsion; $i_1$ is the RMS magnitude of the coil current, and $i_2$ is the RMS magnitude of the induced current in the mold member 18.

Figure 9:
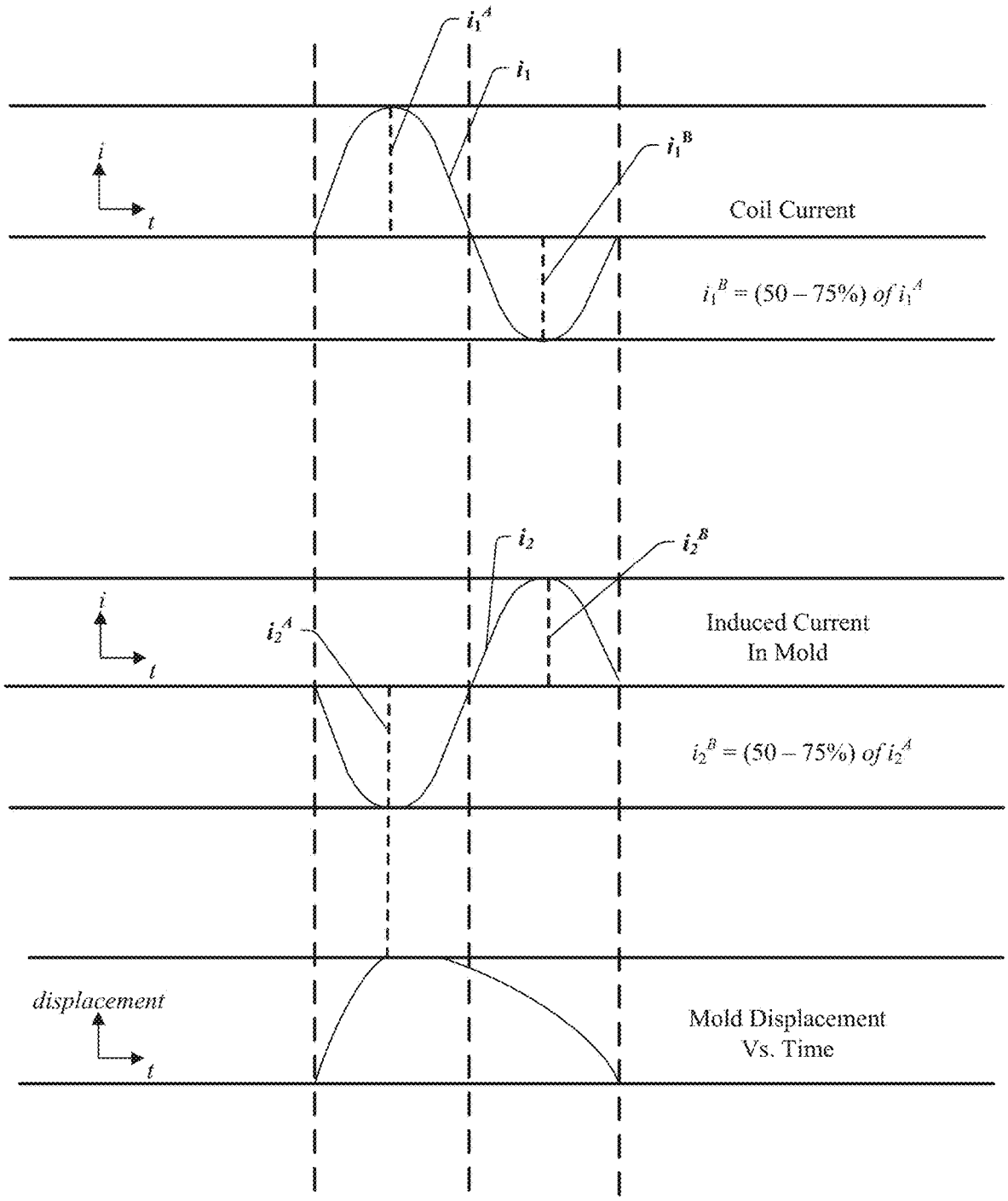
FIG. 9 is a graph of the currents in the coil that determine the pulsing force in accordance with an embodiment of the present invention.

FIG. 9 shows the nature of these currents that determine the pulsing force. It should be noted that the second peak/trough of the pulsating current is 50-75% in magnitude of the first one:

$$i_1^B = (50\text{-}75\%) \text{ of } i_1^A$$

Similarly, $$i_2^B = (50\text{-}75\%) \text{ of } i_2^A$$

FIG. 9 also gives the mold displacement characteristics within the duration of a pulse. The displacement is proportional to the repelling force and peaks early in the pulse cycle, and then decays towards the end of the pulse cycle. Because the pulse coil 36 is fully restrained by the steel compression rods 33 and by the housing 34, it does not have any degrees of freedom to move in any direction whatsoever. The mold member 18, on the other hand cannot flex outward beyond its initial stationary non-pulsed configuration, but is free to flex inwardly.

Table 1 provides a summary of exemplary process parameters, which not only enable the process but also allow for process customization, control, and flexibility. These parameters can be changed within a certain range, and can be optimized based on the type of product cast, casting parameters like speed, alloy cast, and required product properties.

TABLE 1

| Typical process parameters in Pulse Mold Casting | |
|---|---|
| Coil current RMS | 2000 amp |
| Frequency of coil current | 1000 Hz |
| Pulse frequency | 10/second |
| Mold thickness | 8 mm |

In Table 1, the current is pulsed in the coil 36, in one embodiment, via a capacitor arrangement. The mold member 18 pulsates in the direction normal to its contact line with the solidifying shell of molten material. The pulsating action reduces the coefficient of friction to almost zero in the direction of product withdrawal. This electromagnetic pulsing obviates the need of a mechanically oscillated mold, allowing for a fixed refractory connection from the tundish 114 to the mold 10, as well and providing stable flow control and flow characteristics of the molten material from tundish 114 to mold 10, and reducing oxidation of the liquid material that enters from the tundish 114 to the mold 10. In addition, the process does not require loop control of the flow control that is required in conventional casting.

Figure 5:
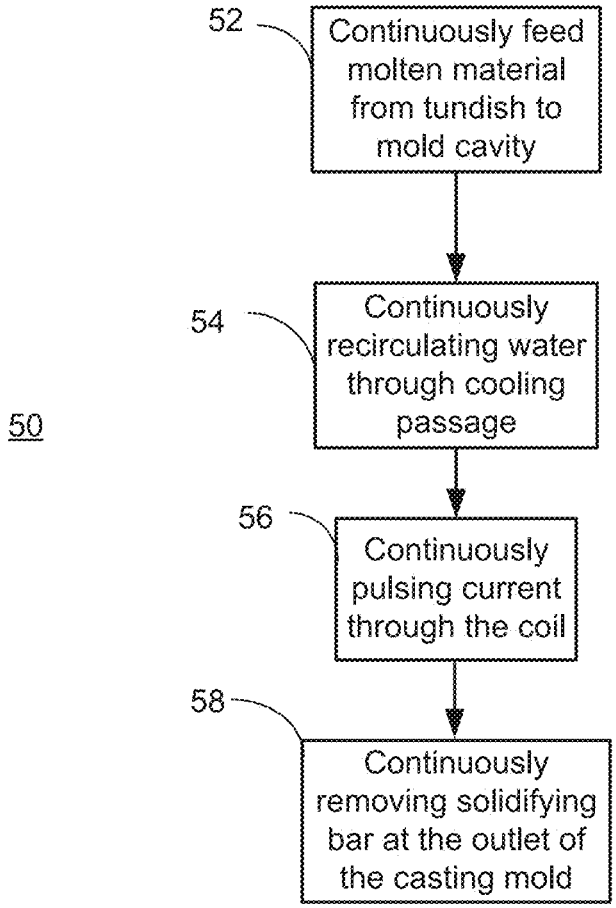
FIG. 5 is a flow diagram of the method of continuous casting in accordance with an embodiment of the present invention using the mold of FIG. 2.

In operation, the process is outlined in FIG. 5 and generally referenced by the number 50. In step 52, molten material, such as metal or metal alloy, is continuously fed from the tundish 114 to the inlet end 14 into the mold cavity 12 in step 52. The pressure of molten material in the tundish 114 causes the molten material to flow continuously through the mold cavity 12.

Cooling water continuously flows from inlet pipe 26 to the annular cooling passage 20 out to the outlet pipe 32 in step 54. The cooling water continuously flowing through the cooling passage 20 causes molten material closest to the internal wall 19 of the mold cavity 12 to cool and continuously solidify via heat transfer, while radially inwardly thereof, the material remains molten. It is preferable to use cooling water flow rates that are high enough so the cooling water does not boil.

In step 56, pulsed current is continuously passed through the coil 36 which encircles the mold member 18. This continuously pulsed current causes an induced current in the mold member 18. The interaction of these two currents (coil current and induced current) creates a repelling force between the coil 36 and the mold member 18. This force tends to displace the mold member 18 in a direction perpendicular to casting (that is, the direction of primary molten material flow and product withdrawal).

Figure 6:
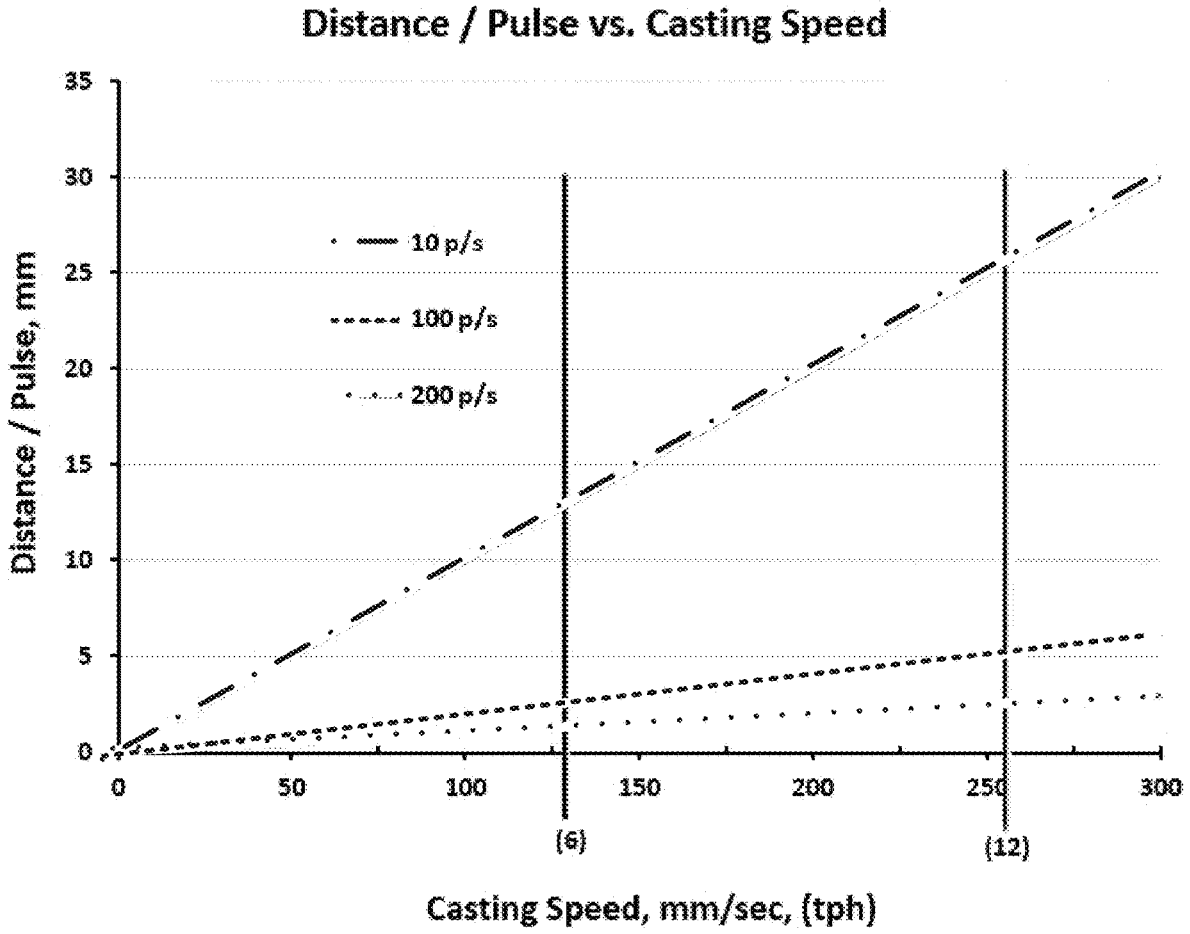
FIG. 6 is a graph relating distance/pulse versus casting speed for a mold as shown in FIG. 2.

FIG. 6 is a graph showing the relationship between the casting speed and the distance per pulse for pulse frequencies of 10 pulses per second, 100 pulses per second, and 200 pulses per second. At a pulse frequency of 10 pulses per second, a high current allows for one pulse every 13 mm of traversed molten material within the mold. At this frequency, the shockwave into the molten material will be considerable and may be desirable to break dendrites that form as the material cools.

At a pulse frequency of 100 pulses per minute, a reduced current allows for a pulse every 1.3 mm. The breaking of dendrites may not be as effective at this frequency; however, the casting reliability and surface quality may increase.

The pulse creates rapid elastic movement of the mold member 18 causing mold member 18 to move slightly radially inwardly, thereby applying pressure to the solidifying shell. Since the molten material has a skin of solid material resulting from the cooling induced by the passage of cooling water through the cooling passage 20, the material does not relax to the same extent as the mold member 18 before the next pulse again induces radially inward movement of the mold member 18. As the material flows through the mold cavity 12, more of the cross-section of the material solidifies. Effectively, therefore, the solidifying material detaches from the inner wall of the mold cavity by the rapid reciprocal radial movement of the mold member 18.

Unlike U.S. Pat. No. 4,522,249, wherein the flowing molten material is subjected to flexure under the influence of the magnetic field which may create flow patterns in the molten material, in the present invention, the mold member 18 is flexed, moving the molten material away from the solidifying shell of the forming billet or bar 115 and flowing continuously in a single direction downstream within the mold cavity 12.

The flexure of the mold member 18 creates zero or near-zero friction between the inner mold wall 19 and the solidifying shell of the bar 115 to permit ready withdrawal from the mold cavity 12, in step 58, without the formation of significant surface imperfections or blemishes, thereby overcoming the problems of the prior art. The absence of surface defects permits the casting to be forwarded directly to a rolling mill or other forming methods.

Figure 10:
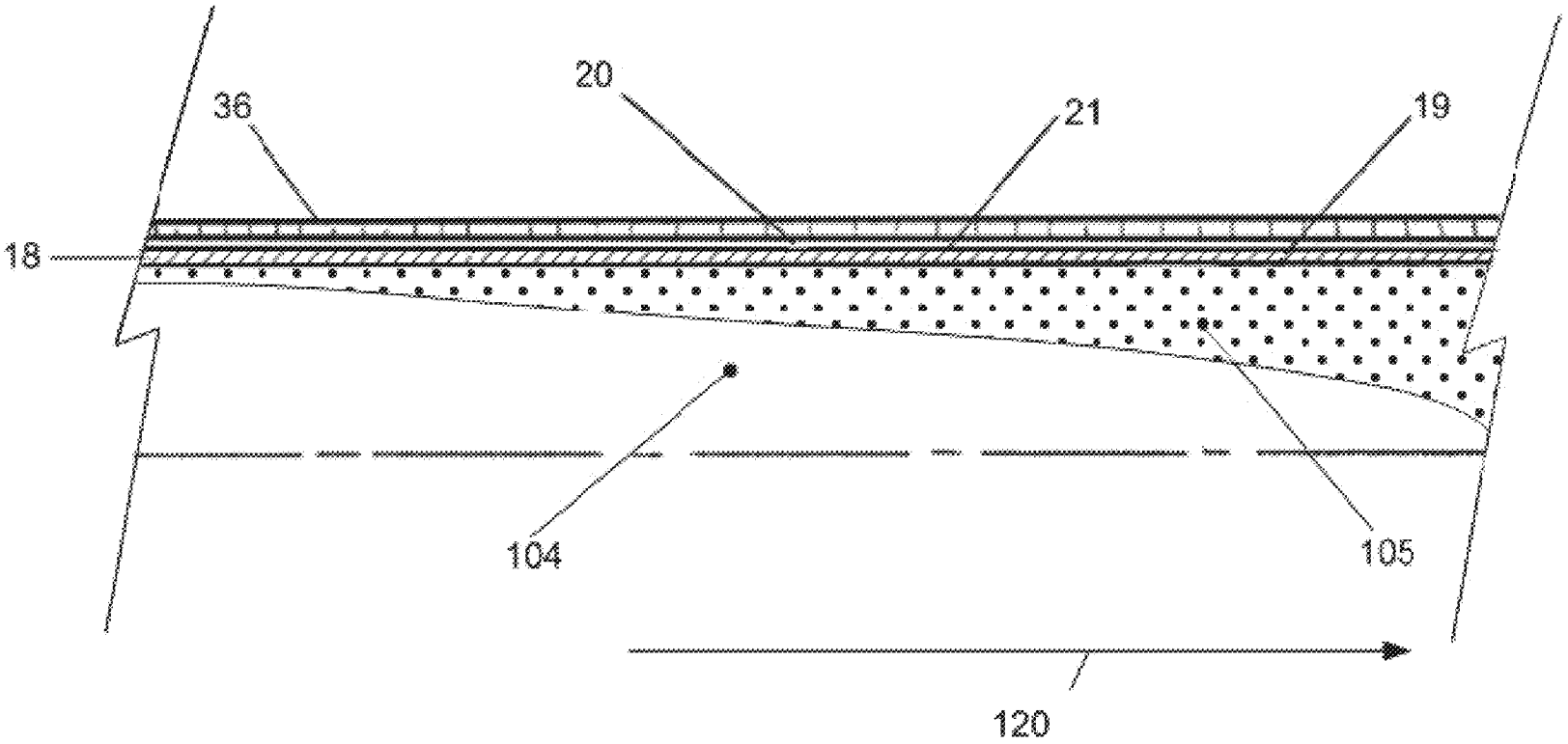
FIG. 10 is a partial vertical cross-sectional side view of an exemplary continuous casting mold in accordance with an embodiment of the present invention illustrating the solidification of the casting material therein during the horizontal casting process in accordance with an embodiment of the present invention.

FIG. 10 shows a cross-section of a horizontal casting process where the solidifying shell 105 of the bar 115 increases in thickness in the casting direction. The thickness depends on the material, such as the metal or alloy being cast. The electromagnetic fields are induced in the mold member 18 and any electromagnetic fields induced in the solidifying shell 105 of the bar 115 or the molten material are negligible.

Figure 4:
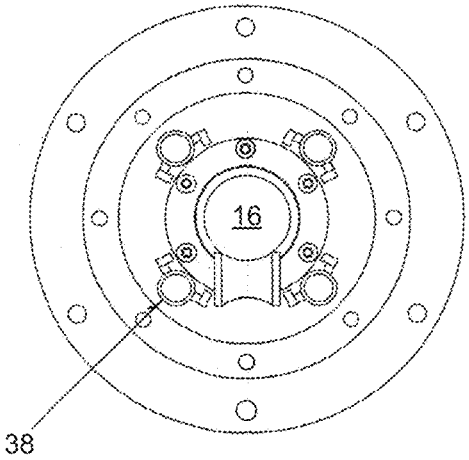
FIG. 4 illustrates the outlet end of the mold of FIG. 2.

Ultimately the material throughout the cross-sectional dimension solidifies enough so that a billet or bar of material, such as metal or metal alloy, is removed from the outlet 16 from the casting cavity 12 in step 58 in FIG. 5. FIG. 4 shows the outlet end 16 of the mold 10. Spray nozzles 38 cool the hot solidifying material as it exits the mold from the outlet end 16. Continuous withdrawal of the billet is required to pull the product from the mold outlet end 16. Withdrawal may include but is not limited to cutting the product to length using a fly shear, gas cutter or other means, continuously in-line feeding the product directly into another processing step such as a rolling mill, and winding the product into a spool (depending on the shape and thickness of the product).

In the examples of aluminum alloy 2024 or aluminum alloy 6061, for a bar having a cross section of 3680 $mm^2$, a casting speed of 10.5 m/min (0.175 m/s) can be obtained through the exemplary casting mold 10 of FIG. 2. For these alloys, a tonnage throughput of about 6 tonnes per hour is obtained for a density of 2700 $kg/m^3$. In the example of aluminum alloy 1350, for a bar having a cross section of 3680 $mm^2$, a casting speed of 17 m/min (0.283 m/s) can be obtained through the exemplary casting mold 10 of FIG. 2. For this alloy, a tonnage throughput of about 10 tonnes per hour is obtained for a density of 2700 $kg/m^3$. Thus, for an aluminum alloy bar having a diameter of 2.7 inches, 1 tonne per hour is equivalent to a bar speed of 0.3 m/s.

Cooling water flow rates are high enough that the cooling water will not boil due to the heat transfer from the mold member 18. Superheat temperature is rapidly extinguished and freezing of material begins near the mold entrance 14. For lower cooling rates, there is a lower overall heat transfer rate through the mold member 18, resulting in a higher liquid fraction in the bar at the mold exit 16. Controlling cooling flow rates and casting speed are combined to optimize the solid shell thickness of the bar at the mold exit 16. In the example of aluminum alloys 6061 and 2024, a bar of aluminum alloy 6061 will likely have a larger shell thickness at the mold exit 16, but is easier to chill cast than aluminum alloy 2024. Thus, with high enough water flow rates and a casting velocity corresponding to a throughput of 6-10 tonnes per hour, aluminum alloys 6061 and 2024 can be cast using horizontal direct chill casting.

Figure 7:
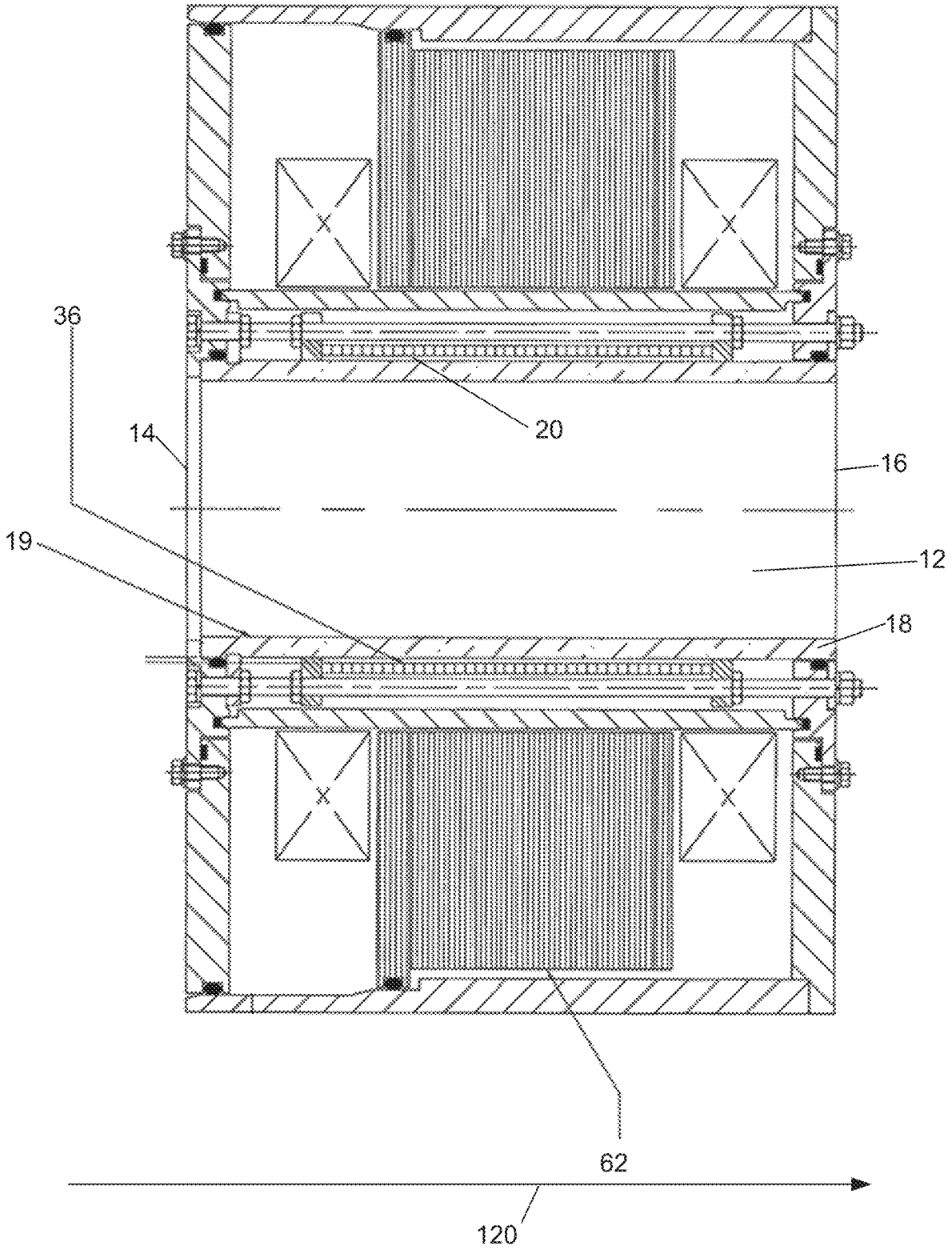
FIG. 7 illustrates a vertical cross-sectional side view of an exemplary continuous casting mold in accordance with another embodiment of the present invention.

FIG. 7 shows an alternate embodiment of a continuous casting mold 60. In this embodiment, electromagnetic stirring may be added to the process. Electromagnetic stirrers 62 are placed circumferentially around the external mold wall 21. The electromagnetic stirrers 62 provide induced electromagnetic forces to the solidifying molten material to bring about several process changes and changes to quality of the final product, such as breaking dendrites which act as nucleation sites for solidification of small grains. In aluminum and aluminum alloy casting, for example, a finer grain size promotes improved casting soundness by minimizing shrinkage, hot cracking, and hydrogen porosity. Other advantages of effective smaller grain size may include improved tear resistance, mechanical properties, response to thermal treatment, and appearance following chemical, electrochemical, and mechanical finishing. The addition of electromagnetic stirrers 62 may enhance heat transfer. Enhancing heat transfer and breaking dendrites may also result in finer grain size.

The electromagnetic stirrers 62 may be placed in three different zones on the mold: i) where most of the molten material is still in a liquid form; ii) where the molten material is a substantial combination of solid and liquid or mushy within the area where the mold is being pulsed; or iii) in a substantially mushy area outside the area of the mold that is being pulsed. Stirring is effective if it is imposed on liquid material, less so on mushy material, and ineffective on solid material. The solid shell of the material being cast is growing in the direction of casting, as shown in FIG. 10. The electromagnetic stirrers 62 must penetrate a larger thickness of shell where the material has solidified. Each stirrer in each area of solidifying thickness of molten material operates under different electrical conditions in order to maximize the stirring effectiveness. In terms of effectiveness, stirring in the liquid zone is most effective, however, stirring in the combined liquid and mushy areas, and in the mushy areas also provide benefits.

In another embodiment, the electromagnetic stirrers 62 may be placed in all three of these areas on the mold or any combination of these three areas to produce stirring in the longitudinal, lateral, or helical directions. The electromagnetic stirrer 62 placement can be adjusted for fluid dynamic and solidification characteristics.

In a further embodiment, electromagnetic stirrers 62 may be placed beyond the exit of the mold. In the continuous casting of alloys with large solidification temperature ranges, a substantial portion of the core of the solidifying bar 115 may be liquid. In such cases, stirring beyond the outlet end 16 may be beneficial if the electromagnetic stirrer is operated such that the electromagnetic fields can penetrate the large shell thickness at that location.

Figure 8A:
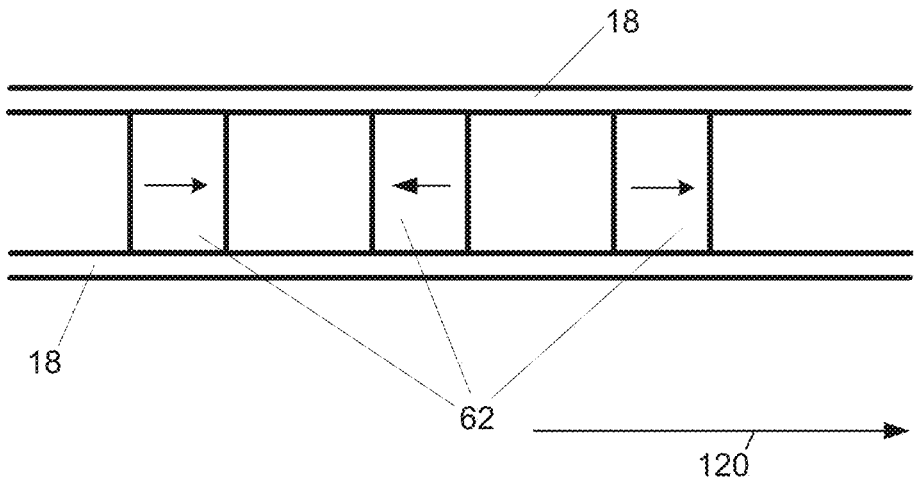
FIG. 8A is a horizontal cross-sectional top view of an exemplary continuous casting mold in accordance with an embodiment of the present invention illustrating the induction of longitudinal stirring in the casting material via the placement of electromagnetic stirrers in accordance with an embodiment of the present invention.

FIG. 8A is a horizontal cross-sectional top view showing the placement of electromagnetic stirrers 62 on the mold member 18 for an embodiment of a continuous casting mold, in accordance with the present invention. In this example, the electromagnetic stirrers 62 are placed to effect longitudinal stirring in the molten material as it solidifies in the mold.

Figure 8B:
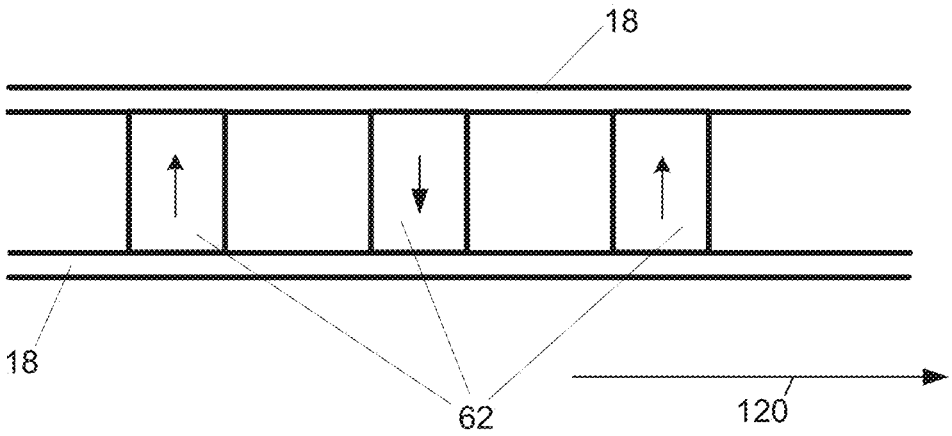
FIG. 8B is a horizontal cross-sectional top view of an exemplary continuous casting mold in accordance with an embodiment of the present invention illustrating the induction of lateral stirring in the casting material via the placement of electromagnetic stirrers in accordance with another embodiment of the present invention.

FIG. 8B is a horizontal cross-sectional top view showing the placement of electromagnetic stirrers 62 on the mold member 18 for an embodiment of a continuous casting mold, in accordance with the present invention. In this example, the electromagnetic stirrers 62 are placed to effect lateral stirring in the molten material as it solidifies in the mold.

Figure 8C:
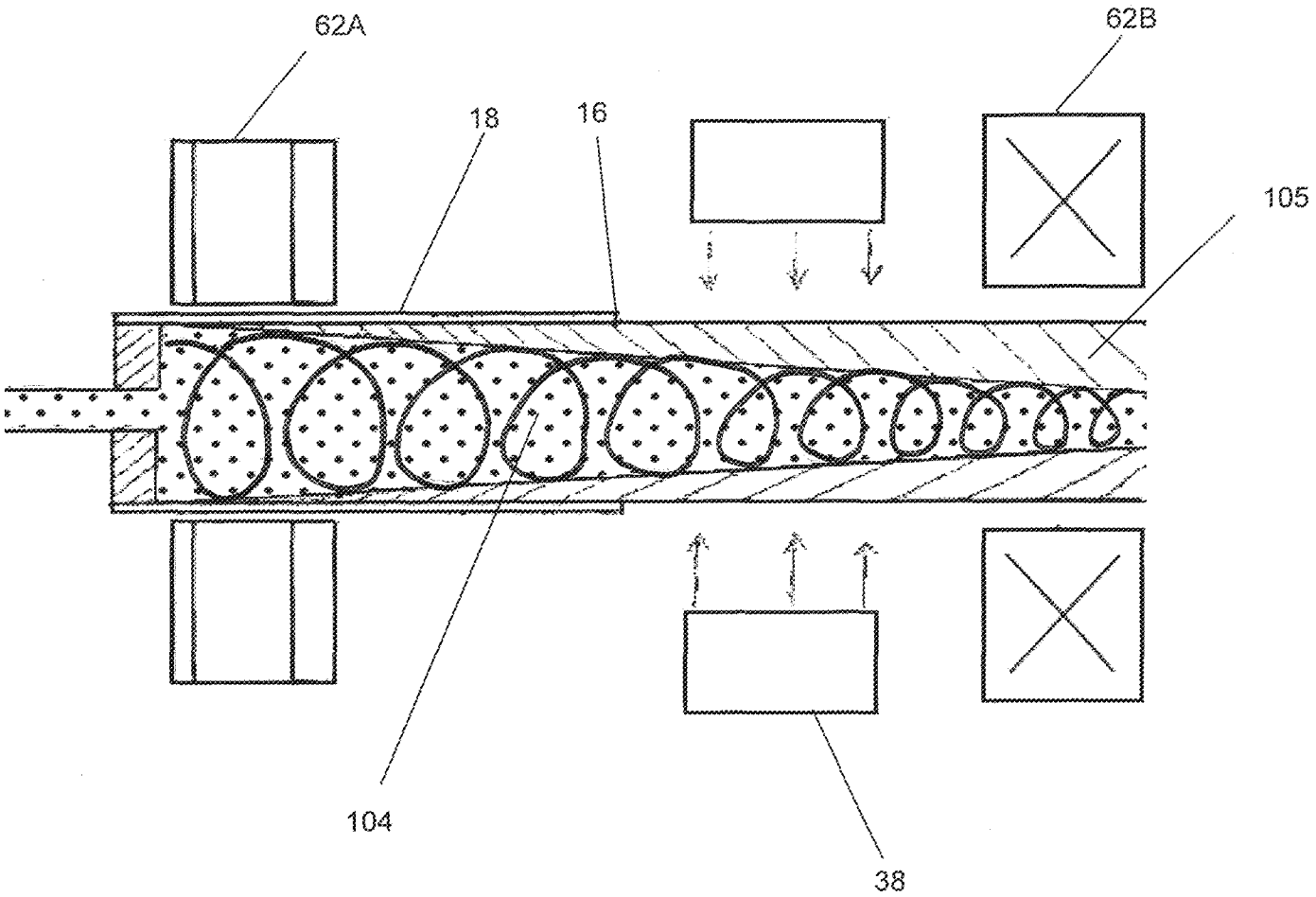
FIG. 8C is a vertical cross-sectional side view of an exemplary continuous casting mold in accordance with an embodiment of the present invention illustrating the induction of circumferential/helical stirring in the casting material via the placement of electromagnetic stirrers in accordance with an embodiment of the present invention.

FIG. 8C is a vertical cross-sectional side view showing the placement of in-mold electromagnetic stirrers 62A on the mold member 18 for an embodiment of a continuous casting mold, in accordance with the present invention, and the placement of electromagnetic stirrers 62B after the outlet end of the mold 16 and the secondary cooling zone, in this embodiment, provided by spray nozzles 38. In this example, the electromagnetic stirrers 62A and 62B are placed to effect helical/circumferential stirring in the molten material 104 as it solidifies (see solidifying shell 105).

In some cases, helical/circumferential stirring may be more beneficial than longitudinal stirring and in some cases a combination of both, helical/circumferential and longitudinal stirring, may be useful.

The above-described embodiments and method may be used in the casting of metals including but not limited to steel, aluminum, copper, and their various alloys.

The above-described embodiments are intended to be examples of the present invention and alterations and modifications may be effected thereto, by those of skill in the art, without departing from the scope of the invention, which is defined solely by the claims appended hereto.

It should be understood that the phrase "a" or "an" used in conjunction with the Applicant's teachings with reference to various elements encompasses "one or more" or "at least one" unless the context clearly indicates otherwise. Additionally, conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

While the Applicant's teachings have been particularly shown and described with reference to specific illustrative embodiments, it should be understood that various changes in form and detail may be made without departing from the scope of the teachings. Therefore, all embodiments that come within the scope of the teachings, and equivalents thereto, are claimed. The descriptions and diagrams of the methods of the Applicant's teachings should not be read as limited to the described order of elements unless stated to that effect.

While the Applicant's teachings have been described in conjunction with various embodiments and examples, it is not intended that the Applicant's teachings be limited to such embodiments or examples. On the contrary, the Applicant's teachings encompass various alternatives, modifications, and equivalents, as will be appreciated by those of skill in the art, and all such modifications or variations are believed to be within the scope of the invention.

What is claimed is:

1. An apparatus for continuous casting of molten material, said apparatus comprising:

an elongate mold of electrically conductive material having an inner and an outer wall defining a molding cavity therein, the inner and outer walls having a first end having an inlet for receiving a fed molten material and a second end having an outlet for removing a solidifying cast product formed from the molten material;

an electrical coil with an inner surface and an outer surface, the electrical coil arranged to surround the outer wall of the elongate mold;

compression rods to restrain the electrical coil; and an annular channel defined by the outer wall of the elongate mold and the inner surface of the electrical coil, the annular channel for receiving a flow of cooling water from a water inlet and passing the cooling water therethrough to a water outlet;

wherein when pulsating current passes through the electrical coil, a counter current is induced in the elongate mold causing a repelling force between the electrical coil and the elongate mold, thereby causing inward radial flexure of the elongate mold.

2. The apparatus of claim 1, wherein said pulsating current has a pulse duration of about 1 millisecond to about 2 milliseconds and an intensity of about 1000 to about 5000 amperes peak.

3. The apparatus of claim 1, wherein the pulsating current has a pulse interval of about 10 to about 100 times per second.

4. The apparatus of claim 1, wherein the elongate mold is arranged substantially horizontal.

5. The apparatus of claim 1, wherein the elongate mold has a substantially:

circular cross-section;

rectangular cross-section; or dog-bone cross-section.

6. The apparatus of claim 1, wherein the molten material is selected from the group consisting of steel, aluminum, aluminum alloy, and aluminum based metal-matrix composite.

7. The apparatus of claim 1, wherein the electrically conductive material is copper.

8. An apparatus for continuous casting of molten material, said apparatus comprising:

an elongate mold of electrically conductive material having an inner and an outer wall defining a molding cavity therein, the inner and outer walls having a first end having an inlet for receiving a fed molten material and a second end having an outlet for removing a solidifying cast product formed from the molten material;

an electrical coil with an inner surface and an outer surface, the electrical coil arranged to surround the outer wall of the elongate mold, wherein when pulsating current passes through the electrical coil, a counter current is induced in the elongate mold causing a repelling force between the electrical coil and the elongate mold, thereby causing inward radial flexure of the elongate mold;

compression rods to restrain the coil;

an annular channel defined by the outer wall of the elongate mold and the inner surface of the electrical coil, the annular channel for receiving a flow of cooling water from a water inlet and passing the cooling water therethrough to a water outlet; and electromagnetic stirrers arranged:

substantially circumferentially around the elongate mold to induce electromagnetic forces to cause the molten material to be stirred within the molding cavity;

substantially circumferentially around the cast product beyond the second end of the elongate mold; or around the elongate mold to induce electromagnetic forces to cause the molten material to be stirred within the molding cavity and arranged substantially circumferentially around the cast product beyond the second end of the elongate mold.

9. The apparatus of claim 8, wherein when the electromagnetic stirrers are arranged substantially circumferentially around the elongate mold to induce electromagnetic forces to cause the molten material to be stirred within the molding cavity or around the elongate mold to induce electromagnetic forces to cause the molten material to be stirred within the molding cavity and arranged substantially circumferentially around the cast product beyond the second end of the elongate mold, the electromagnetic stirrers are placed around the elongate mold in areas where the molten material is still substantially liquid, areas in which the elongate mold is being pulsated where the molten material is solidifying, and areas in which the mold is outside the pulsating current where the molten material is solidifying.

10. The apparatus of claim 8, wherein the electromagnetic stirrers stir in a substantially:

longitudinal direction corresponding to a direction substantially parallel to a direction in which the molten material is fed;

lateral direction corresponding to a direction substantially perpendicular to a direction in which the molten material is fed; or helical direction.

11. The apparatus of claim 8, wherein said pulsating current has a pulse duration of about 1 millisecond to about 2 milliseconds and an intensity of about 1000 to about 5000 amperes peak.

12. The apparatus of claim 8, wherein the pulsating current has a pulse interval of about 10 to about 100 times per second.

13. The apparatus of claim 8, wherein the elongate mold is arranged substantially horizontal.

14. The apparatus of claim 8, wherein the elongate mold has a substantially:

circular cross-section;

rectangular cross-section; or dog-bone cross-section.

15. The apparatus of claim 8, wherein the molten material is selected from the group consisting of steel, aluminum, aluminum alloy, and aluminum based metal-matrix composite.

16. The apparatus of claim 8, wherein the electrically conductive material is copper.

* * * * *